United States Patent [19]

Elliott et al.

[11] Patent Number: 4,954,280

[45] Date of Patent: Sep. 4, 1990

[54] MACHINE DISHWASHING COMPOSITION

[75] Inventors: David L. Elliott, Hawthorne; Steven P. Christiano, Maplewood, both of N.J.; David J. Lang, Ossining, N.Y.; Rosemary M. Sisco, Hackensack, N.J.

[73] Assignee: Lever Brothers Company, New York, N.Y.

[21] Appl. No.: 202,087

[22] Filed: Jun. 2, 1988

Related U.S. Application Data

[63] Continuation-in-part of Ser. No. 161,228, Feb. 17, 1988, abandoned, which is a continuation of Ser. No. 62,521, Jun. 12, 1987, abandoned.

[51] Int. Cl.[5] ..... C11D 7/36; C11D 7/56; C11D 17/00

[52] U.S. Cl. ..... 252/90; 252/140; 252/174.25

[58] Field of Search ..... 252/174.25, 140, 90

[56] References Cited

U.S. PATENT DOCUMENTS

| | | | |
|---|---|---|---|
| 3,558,545 | 1/1971 | Lummus | 260/29.6 |
| 3,816,308 | 6/1974 | Blanc | 252/8.5 |
| 4,116,851 | 6/1977 | Rupe | 252/103 |
| 4,374,939 | 2/1983 | Fisk et al. | 523/139 |
| 4,752,409 | 6/1988 | Drapier | 252/94 |

FOREIGN PATENT DOCUMENTS

| | | |
|---|---|---|
| 2116199 | 9/1983 | United Kingdom . |
| 2164350 | 3/1986 | United Kingdom . |
| 2176495 | 12/1986 | United Kingdom . |
| 2185037 | 7/1987 | United Kingdom . |
| 2193724 | 2/1988 | United Kingdom . |

OTHER PUBLICATIONS

Official Laid Open Patent Gazette of the Japanese Patent Office (JP) (A) Feb. 28, 1984 (59/36198).

Official Laid Open Patent Gazette of the Japanese Patent Office (JP) (A) Feb. 28, 1984 (59/36200).

"Formation and Properties of Clay-polymer Complexes", B. K. G. Theng pp. 123-127 (refs., pp. 148-154).

B. F. Goodrich Carbopol brochure European Search Report-EP 88 30 5256.

*Primary Examiner*—John F. Niebling
*Assistant Examiner*—Isabelle Rodríguez
*Attorney, Agent, or Firm*—James J. Farrell

[57] ABSTRACT

A stable liquid automatic dishwashing compositions as well as a process for its preparation is disclosed. The composition is an aqueous thixotropic fluid possessing a yield point. The composition may include swellable clays, synthetic polymers, a specified amount of multivalent cations, builder salts, an alkaline source, a hypochlorite source, nonionic or anionic surfactants, and defoamers. The system containing clay, polymer, and ions thickens the composition to provide structure to suspend finely divided solid components, while maintaining good salt tolerance and stability against hypochlorite.

13 Claims, No Drawings

MACHINE DISHWASHING COMPOSITION

This is a continuation-in-part application of Ser. No. 161,228, filed Feb. 17, 1988, now abandoned, which in turn is a continuation application of Ser. No. 062,521, filed June 12, 1987, now abandoned.

FIELD OF THE INVENTION

This invention relates to liquid automatic dishwashing detergent compositions which are used for the purpose of cleaning soils from dishes, glasses and cookware. More particularly, it provides for such a composition containing a structuring system composed of a swellable clay, a water-soluble polymer, a source of multivalent cations together with a hypochlorite bleach and other common automatic dishwasher detergent components as well as a method for the preparation thereof.

BACKGROUND OF THE INVENTION

The use of liquid compositions for automatic home dishwashing offers several advantages over the more predominant powdered or granular forms. These advantages include greater ease of handling in dispensing and dosing, the substantial elimination of lump formation, "caking", and dust, and improved solubility.

However, satisfactory liquid autodish detergent compositions must meet certain requirements. First, the composition must be a substantially uniform mixture of ingredients to deliver the optimum combination of active components to the wash with each dose. In most current formulations, this requires that the liquid be shaken before each use to remix the components. A satisfactory product should also be substantially stable against physical separation and segregation of its active components or de-mixing. In addition, a high composition viscosity at a low shear rate contributes to physical stability of the liquid and protects against separation of the active components.

Physical stability can be achieved through the use of suspending or viscosifying systems to enhance the liquid rheological properties. Such systems typically maintain viscosity at low shear rate under the high ionic strength conditions present in a built liquid detergent. The agents producing these systems must also be chemically compatible with the other components of the formula, especially chlorine bleach or hypochlorite ion at the high pH where the ion is stable.

A further constraint is that the liquid dishwashing detergent must also be compatible with the dishwashing equipment presently available. Most current home dishwashing machines use detergent cups which have been designed to house powdered or granular solid detergent and deliver it to a specific wash cycle. The cups are not designed to contain low viscosity liquids. Consequently, any liquid for use as an automatic dishwashing composition or detergent must possess a sufficiently high viscosity to be effectively retained in the cup to avoid substantial leakage into the machine during cycles which precede the wash. Excessive leakage leads to under-dosing in the wash cycle and may negatively affect cleaning performance. Although high viscosity is desirable under storage conditions or while the material is in the detergent cup, the liquid must also be readily and conveniently dispensed from its container. Therefore, a liquid that undergoes a viscosity decrease under the influence of applied shear such that the decrease is reversible with time after the removal of shear, is preferable. This behavior is termed thixotropy and is desirable for liquid dishwashing detergents. Agitation of the liquid in the container, by squeezing or shaking, will supply sufficient shear strain to initiate shearthinning behavior and increased liquid flow for dispensing from the container. Optimum flow properties allow for easily pourable liquids or fluids which maintain sufficient viscosity at higher shear rates to prevent or minimize excessive spillage. The liquid must also quickly regain its structure or viscosity after dispensing so it does not undergo substantial leakage from the dispenser cup in the machine.

GB 2 164 350 describes a liquid automatic dishwashing product comprising a liquid phase which is water containing alkali metal tripolyphosphate, clay thickener, a chlorine bleach compound and a water-soluble polymeric carboxylic acid, for example, sodium polyacryate. GB 2 176 495 describes clay thickened liquids stabilised by polyvalent metal salts of long chain fatty acids, for example aluminium tristearate.

It has been discovered that a hypochlorite containing liquid automatic dishwashing detergent composition which includes a structuring system of a swellable clay, a water-soluble synthetic polymer, and a source of multivalent cations substantially minimizes the problems of the art. This combination also gives a positive effect on the rheology of the product due, it is theorized, to interaction between the components. This positive interaction is manifested in apparent viscosity increases (at shear rates up to 450 $sec^{-1}$) and in yield point increase. The art details various kinds of structuring systems containing clay, polymer, or related combinations; but these are not completely satisfactory. The remarkable increase in yield point observed in this system together with superior hypochlorite stability further increases the desirability of the combination.

Improved rheology of the composition can result in improved detergent performance through better retention in the cup and better stability against separation which provides increased reliability in dosing the proper levels of active ingredients to the machine wash cycle. Further the improved structuring system also results in improved product dispensability.

DETAILED DESCRIPTION OF THE INVENTION

Broadly, this invention includes:

(a) a substantially stable viscosifying or structuring system of three components, a swellable clay, a water-soluble polymer, and a multivalent cation in a ratio such that an enhanced rheological effect occurs with the polymer, clay, and multivalent metal ions in combination with hypochlorite ion at an appropriate pH;

(b) a source of hypochlorite ion or chlorine bleach, such as sodium hypochlorite;

(c) a mixture of customary additives such as builder salts (phosphates) alkaline sources (sodium carbonate, sodium hydroxide, sodium silicates, etc.), optional surfactant (nonionic or low-foaming), and defoamer; and (d) a method of making the composition.

The positive interaction which occurs between the swelling clay, the water soluble synthetic polymer and the multivalent cation is beneficial in that it provides an enhancement of the yield point and of the low shear viscosity of the liquid. Several performance advantages can be gained through the enhanced structuring offered by the combination.

The addition of multivalent cations such as aluminum (III) or chromium (III) enhances the rheological properties of the autodish cleaning liquids over those structured by polymer alone, clay alone or polymer-clay combinations. This results in increased yield point and higher viscosity at both low and high shear rates. The combination delivers substantially satisfactory stability against physical separation or segregation of the liquid upon storage. This provides for a more uniform product and for dosing of an optimized mixture of cleaning agents into the machine. Poor physical stability on the other hand can lead to development of a stratified liquid through the separation of a fluid layer to the top of the liquid and segregation of solids to the bottom. A physically separated liquid may be remixed by the end user through vigorous shaking of the bottle but this is not completely desirable. The use of the polymer in combination with the clay and multivalent metal ions provides for stability against separation and syneresis.

The inventive combination, can be disposed in a container with a reclosable dispensing orifice of 6mm to 12mm in axial length; and also produces an enhanced yield point in autodish liquids. Detergent cup retention under wash conditions is higher with liquids possessing a higher yield point. Such retention is related to product cleaning performance since it governs the reliability of the detergent dose delivered to the wash cycle in the machine. The present invention allows for desirable yield points with lower levels of insoluble clay minerals to be used in automatic dishwashing liquid detergents. Liquids structured with clay alone can develop a high yield point if sufficient quantities of clay are used, however, the presence of insoluble clay minerals or silica negatively affects glass spotting and filming performance. The combination as described in the present invention has an advantage over a composition structured with synthetic polymers alone in that an otherwise unattainable yield point is achieved. Liquids containing for example, polyacrylate as the only structuring agent do not appear to possess a yield point and consequently suffer from poor cup retention.

Biopolymers known to the art react readily with hypochlorite and such chemical instability towards hypochlorite will lead to eventual loss in viscosity of the liquid. Liquids structured with multivalent metal cations and homopolymers of acrylic acid in combination with swelling clays and also containing hypochlorite are found to be rheologically stable. By using a synthetic polymer such as polyacrylate or a modified polyacrylate in conjunction with clay and an appropriate multivalent metal cation, an acceptably good chemical stability of the structuring system is achieved due to the less reactive nature of the combination of multivalent ions, synthetic polymers and swelling clay towards hypochlorite.

The combination described in this invention constitutes an efficient and cost-effective structuring system. The color of swelling clays available in bulk quantities ranges from off white to shades of brown or yellow. The whiter clays are preferred for use in a consumer product where color is an important factor. The high purity white clays tend to be significantly more expensive than the off color varieties. The use of the combined clay/polymer/multivalent ion structuring system allows for lower quantities of clay to be used. Thus, a lower quantity of a pure white clay can be used at a moderate cost savings because the polymer/multivalent ion combination is less expensive than the clay. Alternatively, a less expensive off color clay may be tolerated because in combination with the polymer and multivalent ions lower concentrations of clay are required.

The structuring system of this invention can be tailored to develop an optimum fluid rheology in terms of low shear rate attributes (physical stability and cup retention) and moderate shear rate flow behavior during dispensing. Because the structuring system is composed of more than one part, the clay content can be modified independently of the polymer content or the cation concentration. Thus, the rheology of the liquid can be optimized more easily than a one or two part system.

The liquid automatic dishwashing detergent of this invention is in the form of a slurry-like paste. This thixotropic material possesses a yield point as determined with a rotational viscometer (Haake Rotovisco RV100) with a cup and bob sensing configuration. Measurements are made with a linearly increasing shear rate of 15 $sec^{-1}$/min. Yield point is practically measured herein as the stress level at which the stress vs. shear rate curve initially deviates from linearity.

The liquid has a yield point of about 5 to 150 pascals or even higher at 25° C. Preferably 30 to 100 and most preferably about 40 to 80 pascals at 25° C. for ease in processing and dispensing from the container. The liquid cleaning agent should also possess a viscosity of about 0.1 to 15 pascal seconds at 25° C. and 21 $s^{-1}$, preferably 1 to 9 pascal seconds and, most preferably 1.5 to 5, to facilitate dispensing and processing.

The swelling clay component of the structuring system may be a clay mineral of the smectite type. The clay can be naturally occurring or synthetic and of the dioctahedral or trioctahedral type. Examples of the natural clays that may be used in this invention are montmorillonites, hectorites, nontronites, beidillites, saponites, and sauconites. Materials of this type are available under the names of Gelwhite GP and Thixagel (trade names of Southern Clay). Synthetic swelling clays such as Laponite (trade name of Laporte Industries) may also be used. The smectite type clay should preferably be in an alkali or alkaline earth metal exchange form and should be white or most preferably of a high white purity. Peptizing agents, such as hexametaphosphate, pyrophosphate, or other polyelectrolytes known to the art may be used. The clay may be present at about 0.1 to 15%, preferably about 1 to 5%, and most preferably about 1 to 4% by weight of the final products. The use of excessive amounts of clay within the formulas which contain high levels of other solids can lead to viscosities considerably above the preferred range.

The polymer used should be of a synthetic type and be water soluble. Preferably, the polymer should also be anionic. Examples of applicable polymers are water soluble carboxylic polymers such as polyacrylic acid and its salts, polymethacrylic acid and its salts, copolymers of acrylic acids or methacrylic acids with comonomers such as alkyl acrylates, alkyl methacrylates, and polymaleic acids and their salts. The preferred salts are alkali metal salts such as for example sodium. These polymers may have a weight average molecular weight of from about 60,000 to about 2,000,000 or higher with a molecular weight of from 60,000 to 500,000 preferred, and 100,000 to 300,000 most preferred. The polymers may be used in the acid or the neutralized form. The polymers should be of a hypochlorite stable type with polyacrylate and polymethacrylate being most preferred. The polymer should be of a purity such that it contains a minimum of unsaturated monomers, chemically reactive initiators, terminators, or surfactants present all of which hasten the rate of hypochlorite decomposition. The polymer may be present in the formula at about 0.05 to 8% by weight, from 1 to 4% being preferred, and from about 1 to 3% by weight being most preferred. The use of excessively high polymer concentrations can lead to gumminess and extremely high viscosities. Excessively high polymer molecular weights can produce liquids with a very stringy and pituitous flow behavior. A source of soluble or solubilized multivalent cations is the third component of the viscosifying system, preferably employing inorganic chlorides, sulfates and the like. Trivalent cations ($M^{3+}$) such as aluminum (III), chromium (III), and iron (III) may be employed as well as divalent cations ($M^{2+}$) or cations with higher valencies. The source of ions should be present in the formula at about 0.01 to 3% by weight with 0.01 to 2% more preferred and 0.01 to 1.0% the most preferred. Examples of metal ions include:

| Group #: | Example: |
|---|---|
| IIA | barium |
| IVA | titanium, zirconium |
| VIA | chromium |
| VIIA | manganese |
| VIIIA | iron, cobalt, nickel |
| IB | copper |
| IIB | zinc |
| IIIB | aluminum |
| IVB | tin |

Several of these ions, however, are not favored in consumer products because of toxicity, cost, color and appearance and will be of only marginal utility. In addition, since hypochlorite stability is critical, the metal ion employed must not substantially deleteriously affect this stability. Aluminum, zinc, and tin, are preferred. Practically, aluminum is the most preferred species.

An alkali metal condensed phosphate may be present in the formula as a water hardness sequestering agent or builder. Tripolyphosphate is the preferred sequestrant although pyrophosphate, hexametaphosphate, or other condensed phosphates may be used. The sequestrant may be present in the formula from about 0.1 to 35% with 15 to 25% by weight being more preferred. Use of the sequestrant, such as sodium tripolyphosphate, in excess of its solubility limit within the formula requires that the solid be present as fine particles which are suspended by the structuring system. The presence of solids will affect the viscosity of the liquid and may modify the range of the structurants needed to deliver the proper rheology.

Other inorganic builders which may be used are sodium and potassium salts of polyphosphate, orthophosphate, carbonate, bicarbonate, sesquicarbonate and borate.

Organic detergent builders can also be used in the present invention. They are generally sodium and potassium salts of the following: citrate, nitrolotriacetates, phytates, polyphosphates, oxydisuccinates, oxydiacatates, carboxymethyloxy succinates, tetracarboxylate, starch and oxidized heteropolymeric polysaccharides. Sodium citrate is an especially preferred builder.

Water-insoluble aluminosilicate ion-exchange materials may be used as alternative builders (e.g. GB 1 473 201 and 1 473 202 - Henkel). These are crystalline or amorphous materials of general formula $$(Cat_{2/n}O)_x \cdot Al_2O_3(SiO_2)_y \cdot ZH_2O$$

wherein Cat is a cation having a valency n that is exchangeable with Calcium (e.g. $Na^+$or $K^+$); x is a number from 0.7 to 1.5; y is a number from 1.3–4; and z is such that the bound water content is from 1% to 28% by weight. Preferred is the commercially available product Zeolite type A-

$$Na_2O \cdot Al_2O_3 \cdot 2SiO_2 \cdot 4.5H_2O$$

The sources of alkalinity are used in combination in the more preferred embodiments of this invention. An alkali metal carbonate may be used as an alkaline buffering agent from about 0.1 to 30% or more preferably from 5 to 15% by weight.

Alkali metal silicates with an $SiO_2$:$Na_2O$ weight ratio of about 1.0 to 3.25 may be used as alkaline sources and as anticorrosion agents to protect metal and china surfaces against the harshly alkaline environments present in the wash. The silicate may be used in the form of an aqueous liquor or a solid, preferably present in the formula at about 0.1 to 25% by weight, and more preferably from 5 to 10%.

An alkali metal hydroxide may be used as an alkaline source and as a means to boost the pH of the liquid detergent to a pH of 10 to 13 to stabilize the hypochlorite. A preferable pH range is 11 to 12.5 to optimize hypochlorite stability and consumer safety. Sodium hydroxide in the form of an aqueous liquor or as a solid will be used in the formula to achieve the above pH range, typically about 1 to 2.5% by weight, or higher, depending on the other components.

The surfactants optionally used in this invention may be those normally used in machine dishwashing products provided they are sufficiently stable with hypochlorite. These surfactants should be of the low-foaming type as foam interferes with the dishwasher cleaning action. While this invention is not limited to any particular surfactant or type of surfactant, the surfactant should possess stability against degradation by hypochlorite. The preferred nonionics are condensates of 8 to 12 carbon linear alcohols with polymers of ethylene oxide or propylene oxide in either a random copolymer or as block polymers provided sufficient hypochlorite stability is introduced by appropriate means, such as for example, end capping. Hypochlorite stability is enhanced in surfactants of this type which contain relatively higher propylene oxide to ethylene oxide ratios. Surfactants of these types are present in this invention at about 0.1 to 25% by weight, with from 0.1 to 5% preferred and about 0.1 to 3% most preferred.

Highly foaming surfactants are preferably excluded or are used in only minimal amounts, or if desired with effective hypochlorite stable defoaming agents. Low foaming anionic surfactants are preferred for this invention, especially in combination with effective defoamers, in that these surfactants are shown to be more stable towards hypochlorite. Anionic surfactants may be present in the composition of this invention from about 0.1 to 25% by weight, with from 0.1 to 3% preferred. Examples of these surfactants are alkyl diphenyloxide sulfonates; alkyl sulfonates; alkyl naphthalene sulfonates; and nonionic surfactants as described above in which a sodium alkylene carboxylate moiety has been linked to the terminal hydroxyl group(s) through an ether bond.

Defoaming of the wash may be accomplished by the presence of any of a number of commercially available defoaming agents. These agents may be of the general type of slightly soluble alkyl carboxylates, alkyl phosphates, hydrophobic silicas, silicone defoamers, or many others. In addition to being an effective defoamer the species must be stable to hypochlorite. The defoamer will optionally be present in the composition from about 0.1 to 5% by weight, more preferably from 0.1 to 1%, and most preferably from about 0.1 to 0.5%.

Stable chlorine bleaches known to the art such as alkali metal hypochlorites, chlorine containing organics which yield available chlorine or the like may be present in the formula as agents for removing tea, coffee, and other food stains from cups, dishes, flatware, etc. The bleach source may be present in the mixture at about 0.1 to 10% by weight with the most preferred range being about 0.1 to 2%. Common bleaching agents which are well known in the art may be used. For substantially effective compositions, about 0.1 to about 2% by weight of available chlorine is desirable.

Typical stable colorants or pigments, such as $TiO_2$, fragrances and other adjuvants may be employed as desired with the provision that they must be adjusted to achieve appropriate viscosity and stability.

A summary of the preferred components in this invention is included in the following list:

| Component | Approximate Wt. % |
|---|---|
| Swellable Clay | 1–4% |
| Water-Soluble Polymer | 1–3% |
| Multivalent Ion | 0.01–1.0% |
| Sodium Tripolyphosphate | 15–30% |
| Sodium carbonate | 5–15% |
| Sodium Silicate (1.0–3.25 weight ratio) | 5–15% |
| Sodium Hypochlorite | 0.1–2.0% |
| Sodium Hydroxide (typically) | 1–2.5% |
| Surfactant (optional) | 0–3.0% |
| Defoamer (Optional) | 0–0.5% |
| Adjuvants (Optional) | 0–5% |
| Water | Balance |
| | 100% |

It is to be understood that the sodium cations mentioned above can be replaced with other alkali metal cations while still achieving the benefits of this invention.

The process of this invention incorporates several factors essential to the production of liquids possessing the proper rheological properties. These factors include the order of mixing, the characteristics of the raw materials and the processing temperatures.

In addition, several aspects of the procedure are described which simplify processing on a large scale including the elimination or reduction of viscosity peaks as solids are added. The elimination of the need to homogenize the liquid or to grind undissolved particles in a colloid mill is one important and significant advantage of the present invention pertaining to processing.

Preferred orders of addition effectively combine the structuring components, clay, polyacrylate and multivalent cations in a low electrolyte concentration aqueous solution. This forms a thickening matrix in the absence of excess electrolyte. One portion of the sodium tripolyphosphate, as well as the MSAP premix, surfactant solution, sodium hydroxide present in the polymer premix, colorants, etc., may be present during the admixing of the structuring components. The bulk of the solution electrolyte however is added after the structuring components. The electrolyte is contributed by the alkali metal silicate, the alkali metal carbonate, and the remainder of the tripolyphosphate. Hypochlorite bleach is typically added last after cooling of the mixture.

The order of addition and approximate temperature ranges are illustrated in the following list:

| Component | Preferred Temp. °C. |
|---|---|
| Water | 15–25 |
| Clay | 15–25 |
| | 40–50 |
| Sodium Tripolyphosphate | 50–60 |
| Polymer Premix[1] | 50–60 |
| Multivalent Cation | 50–60 |
| Sodium Silicate (2.4 Ratio) | 50–60 |
| Sodium Carbonate | 50–60 |
| Defoamer | 50–60 |
| Surfactant | 50–60 |
| Sodium Tripolyphosphate | 50–60 |
| Sodium Hypochlorite | 20–30 |

[1]The polymer premix is prepared by combining sodium hydroxide 50% liquor with a polymer solution.

Interaction of the components that structure the liquid is accomplished during the early stages of mixing. The advantage is that the majority of the alkaline salts are added after the interactions are complete thus avoiding the interfering effects of high electrolyte solution concentrations The structuring components are the clay, the polymer and the multivalent cation source. Very low electrolyte concentrations are preferred to hasten the rate and extent of clay swelling which is essential for the development of the structuring system. A partial flocculation of the clay occurs upon the dissolution of the STP. These flocculates are desirable to increase the adsorptive interaction of the polymer with the clay particles. Addition of cations should occur prior to the addition of the carbonate and silicate to increase the effectiveness of the multivalent metal ion/clay/polymer interactions.

The addition of the raw materials are well balanced to eliminate any periods of high viscosity during the mixing process. In the absence of any specific interactions the order of addition has been chosen to use additions of raw materials in the physical form of solutions to offset the addition of quantities of powders.

The sodium tripolyphosphate (STP) is split into two separate additions. This method of addition offers a significant enhancement of the final batch rheology compared to a single addition.

Raw material selection plays an important role in determining the ease of mixing and the rheological quality and smoothness of the final product. Tripolyphosphate characteristics are critical to the process. The STP used in the process is a commercially available material which provides for the proper granulation type, anhydrous crystalline phase content and prehydration conditions. The sodium tripolyphosphate of choice is a medium to light density granular anhydrous form with a preferred unpacked bulk density of about 0.45 to 0.85 g/cc, with a more preferred range of 0.50 to 0.8, and the most preferred density of from 0.50 to 0.7. Preferred levels of prehydration are from 0.1 to 6.0 wt. % water, with the more preferred range being from 0.1 to 2.0, and the most preferred from 0.1 to 1.4. The preferred anhydrous sodium tripolyphosphate crystalline phase Type I content is from 20% to 60 wt. %, with the more preferred content from 25% to 55%, with the most preferred range of from 30% to 50%. The STP selection plays a major role in controlling the grittiness of the final liquid and the mixing time involved in processing.

Selection of the clay is another critical factor in the process. The clay must be both easily dispersed in cold water and quickly swelled in warmer water. A number of swelling clays possess both attributes. Peptizing agents may be useful in both of these processing steps.

The temperature parameters outlined above are also criticalities of the process. Control of the mixture temperature within about +/−10° C. of those described is essential to the success of the process. The maintenance of low (15–25° C.) water temperature eases the dispersion of the clay. Raising the temperature to 40–50° C. increases the swelling rate of the clay, thus allowing for shorter mixing times. Addition of the STP at this temperature allows for rapid hydration of that salt and for the exothermic nature of the reaction. The exotherm causes the temperature of the mixture to rise about 5° C. About 65° C. is a maximum temperature and a criticality of the process, substantially exceeding this temperature has a deleterious effect on the viscosity and rheology of the final product. The mixture should be cooled before hypochlorite addition to minimize degradation.

The cooling rate has a major influence on the rheological quality of the final product. Too slow a rate (less than about 0.5° C./min.) results in a final product that is too low in viscosity. The preferred temperature for hypochlorite addition is about 30° C. or lower.

One of the most important advantages of the process is the elimination of the need to homogenize or mill the product to achieve a uniform, smooth and grit free product. This is an advantage because it eliminates a time consuming and sometimes troublesome step of large scale processing. Plant scale homogenization requires the use of expensive equipment that may require frequent periods of downtime for maintenance. Several facets of the process contribute to the elimination of homogenization. Firstly, the dispersion and swelling of the clay in a low electrolyte environment achieves a high state of structuring efficiency without the large input of mechanical energy and shear associated with homogenization. Secondly, the use of anhydrous tripolyphosphate which forces the formation of finely dispersed tripolyphosphate hexahydrate crystals early in the mixing process is beneficial. The use of the anhydrous tripolyphosphate at the end of the batch requires that the phosphate dissolve and recrystallize onto those finely divided nuclei produced initially.

Generally, the process of the invention is thus, (a) preparing an aqueous based dispersed thickening matrix by combining polymer, swellable clay and multivalent cation in the absence of excess electrolyte;

(b) adding a builder and adjuvants to form a slurry;

(c) cooling the slurry; and (d) adding with mixing, an available chlorine source to the slurry.

The following examples, without limiting the scope thereof, will more fully illustrate the embodiments of this invention. All parts, percentages and proportions referred to herein and in the appended claims are by weight unless otherwise indicated.

EXAMPLE I

Three formulations of automatic dishwashing detergent liquids are given below. These contain the same actives content but vary in their structuring systems such that they contains (1) only clay, (2) clay and polymer, and (3) clay, polymer and metal ion (aluminum). The procedure given below is for formulation (3) containing clay, polymer and aluminum ion.

TABLE 1

| Component | Wt. % In Formulation (1) | (2) | (3) |
|---|---|---|---|
| Gelwhite GP[1] | 2.0 | 2.0 | 2.0 |
| Acrysol A-3[2] | — | 2.0 | 2.0 |
| Sodium Hydroxide | 1.2 | 1.2 | 1.2 |
| Aluminum Sulfate.18 $H_2O$ | — | — | 0.2 |
| Sodium Tripolyphosphate | 12.0 | 12.0 | 12.0 |
| Sodium Carbonate | 7.0 | 7.0 | 7.0 |
| Sodium Silicate (2.4:1 ratio of $SiO_2$:$Na_2O$) | 6.46 | 6.46 | 6.46 |
| Sodium tripolyphosphate | 9.36 | 9.36 | 9.36 |
| Sodium Hypochlorite (available chlorine) | 1.0 | 1.0 | 1.0 |
| Water | balance | balance | balance |
| | 100.0% | 100.0% | 100.0% |

[1]Gelwhite GP is a trade name of Southern Clay, Inc. for a peptized sodium montmorillonite clay.

[2]Acrysol A-3 is a trade name of Rohm & Haas Company for an acrylic acid homopolymer of molecular weight 190,000.

739.4 g of distilled water at 25° C. was placed in a 2-liter stainless steel beaker. Forty grams of Gelwhite GP was sifted slowly into the water while agitation and shear were supplied with a mechanical stirrer to form a slurry. After the slurry was uniform and smooth, it was heated to 60° C. with continued stirring. Into the slurry was added 160 g of Acrysol A-3 in the form of a 25% solids (solute) solution which had been premixed with 48 g of a 50% sodium hydroxide solution in order to neutralize the polymer. After 10–15 minutes of continued stirring, 4 g of aluminum sulfate eighteen hydrate was added to the mixture followed by 10 minutes of additional stirring. The remaining ingredients were added in the order listed in Table 1 with 5–10 minutes of stirring between each addition. Into the slurry was added 240 g of a granular anhydrous sodium tripolyphosphate, 140 g of granular 100 mesh sodium carbonate, and 274.8 g of a 47 wt % sodium silicate solution with a $SiO_2/Na_2O$ ratio of 2.4 to 1. Next was added 187.2 g of granular anhydrous sodium tripolyphosphate. The mixture was then cooled to 30° C. 166.6 g of a sodium hypochlorite solution with 12% available chlorine was then added and the mixture was stirred vigorously for 10–15 minutes to achieve uniformity.

The resulting automatic dishwashing detergent is a thixotropic opaque liquid which is offwhite in color. The consistency is of a smooth, creamy liquid which possesses a yield point. The yield points and viscosity data were collected using a Haake Rotovisco RV100. The measurements were taken at a uniformly increasing rate of about 15 $s^{-1}$/min. The formulations were tested 24 hours after mixing, and these results are shown for the three formulations in Table 2.

TABLE 2

Rheological Comparison of the Three Formulations

| | (1) | (2) | (3) |
|---|---|---|---|
| Viscosity at 25° C. as measured in Pascal seconds | | | |
| 5 $s^{-1}$ | 5.4 | 8.3 | 9.2 |
| 21 $s^{-1}$ | 1.8 | 2.7 | 2.8 |

TABLE 2-continued

| Rheological Comparison of the Three Formulations | | |
|---|---|---|
| (1) | (2) | (3) |
| Yield Point at 25° C. as measured in Pascals | | |
| 2.2 | 15.6 | 29.0 |

EXAMPLE II

Two formulations of automatic dishwashing detergent liquids are given below which have been prepared using a different method from Example 1. Both contain the fundamental components of the invention, but vary the polymer molecular weight. The procedure given below is for formulation (4) containing Acrysol A-3 ®.

TABLE 3

| Component | Wt % in Formulation (4) | (5) |
|---|---|---|
| Gelwhite GP[1] | 2.0 | 2.0 |
| Sodium Tripolyphosphate (anhydrous) | 10.0 | 10.0 |
| Water-soluble Polymer[2] | | |
| Acrysol A-3 | 2.0 | |
| Acrysol LM-45N | | 2.0 |
| Sodium Hydroxide | 1.2 | 1.2 |
| Aluminum Sulfate.18$H_2O$ | 0.2 | 0.2 |
| Sodium Silicate (2.4:1 ratio of $SiO_2$:$Na_2O$) | 8.36 | 8.36 |
| Sodium Carbonate | 6.0 | 6.0 |
| Defoamer[3] | 0.16 | 0.16 |
| Surfactant[4] | 0.36 | 0.36 |
| Sodium Tripolyphosphate (anhydrous) | 10.0 | 10.0 |
| Sodium Hypochlorite (available chlorine) | 1.0 | 1.0 |
| Water | balance | balance |
| Total | 100.0 | 100.0 |

[1]Gelwhite GP is a trade name of Southern Clay, Inc. for a peptized sodium montmorillonite clay.
[2]Acrysol A-3 and Acrysol LMW-45N are trade names of Rohm and Haas Company for acrylic acid homopolymers of molecular weight 190,000 and 4500, respectively.
[3]The defoamer used in these formulations is stearyl acid phosphate available as "high mono grade" from Occidental Chemical.
[4]The surfactant used is Dowfax 2A-1 and is a trade name of Dow Chemical.

The distilled water (113.32g) was placed in a 1 liter stainless steel beaker at 20° C. Eight grams of Gelwhite GP was sifted slowly into the water while agitation and shear were supplied by a mechanical stirrer to form a slurry. After the slurry was uniform and smooth, it was heated to 45° C. with continued stirring. Into the slurry was added 40g of granular anhydrous sodium tripolyphosphate and after the mixture was uniform, the temperature was increased to 55° C. Next, 32g of Acrysol A-3 which was in the form of a 25% solids (solute) solution was premixed with 9.6g of a 50 wt % sodium hydroxide solution to neutralize the polymer and adjunct the pH. The neutralized alkaline polymer premix was then added to the slurry. After 5 minutes of stirring, 0.8g of aluminum sulfate eighteen hydrate was added to the mixture and stirred for ten minutes. The remaining ingredients were added in the order listed in Table 3, with 5–10 minutes between each addition. Into the slurry was added 71.12g of 47.1 wt % sodium silicate solution with a $SiO_2/Na_2O$ ratio of 2.4 to 1. Next was added 24g of sodium carbonate, followed by addition of 24.64g of a 2.6 wt % premix of stearyl acid phosphate in water. Next, 3.2g of Dowfax 2A-1 surfactant (45% actives) was added. Finally, an additional 40g of granular anhydrous sodium tripolyphosphate was added and the mixture was stirred until uniform. The mixture was then cooled to 30° C. before the addition of 33.32g of a sodium hypochlorite solution with 12% available chlorine. The mixture was then stirred for about 5 minutes to achieve uniformity.

The resulting automatic dishwashing detergent is a thixotropic opaque liquid which is off white in color and which possesses a yield point. The yield points and viscosity data were collected using a Haake Rotovisco RV100. The measurements were taken at a uniformly increasing rate of about 15$s^{-1}$/min. The formulations were tested 24 hours after mixing and the results are shown in Table 4.

TABLE 4

| Rheological Comparison of the Two Formulations | (4) | (5) |
|---|---|---|
| Viscosity at 25° C. as Measured in Pascal Seconds | | |
| 5 $s^{-1}$ | 11.4 | 2.3 |
| 21 $s^{-1}$ | 2.7 | 1.2 |
| Yield Point at 25° C. as measured in Pascals | | |
| | 50 | 19 |

It is clear that the higher molecular weight range is highly preferred to provide appropriate structure. It will also be noted that formulation (4) is similar to formulation (3) in Example 1 yet the yield point in formulation (4) is much higher. This reproducible difference is believed to be attributable to changes made in the process and in the order of mixing.

Table 5 shows the effect of several ions on the yield point of an automatic dishwashing liquid according to the invention as compared to a control without metal salt. This control was run independently yet a close correlation can be seen with formulation (2) of Example I. It can be observed that the addition of these metal cations at a level of 0.2 wt. % of the salt enhances viscosity and yield point. The composition of each formulation is identical to formulation 3 from Example I above except that the specified metal salts are substituted for aluminum sulfate.

TABLE 5

Effect of Metal Cations on Yield Point and Viscosity (25° C.)

| Metal salts | Cations | Yield Point (pa) | Viscosity, pascal seconds 5 $s^{-1}$ | 21 $s^{-1}$ | Enhancement factor |
|---|---|---|---|---|---|
| none | — | 16.4 | 8.3 | 2.7 | — |
| Zinc Chloride | Zn (II) | 23.2 | 9.5 | 3.4 | 4.1 |
| Copper Bromide | Cu (II) | 30.9 | 9.3 | 3.1 | 5.4 |
| Chromium Sulfate | Cr (III) | 17.5 | 11.0 | 4.0 | 3.1 |
| Aluminum Sulfate.18$H_2O$ | Al (III) | 29.0 | 9.2 | 2.8 | 5.1 |
| Aluminum Chloride | Al (III) | 21.3 | 10.0 | 4.2 | 3.7 |
| Tin Chloride .5$H_2O$ | Sn (IV) | 32.2 | 10.3 | 3.8 | 5.6 |

The term enhancement factor is used to describe the increase in the yield point (YP) which occurs when the combination of the invention is used as a structurant. The factor is calculated by dividing the yield point of the sample containing the combination of the three components by the sum of the yield points of samples which contain clay, polymer and multivalent metal cation individually.

$$\text{Enhancement Factor} = \frac{YP \text{ of samples}}{YP \text{ of } 1 + YP \text{ of } 2 + YP \text{ of } 3}$$

The YP of the inventive compositions containing the metal cations polymer/clay combination is measured and reported above. The YP of the individual components is reported below.

| Yield Points of individual components | | | |
|---|---|---|---|
| WT % | (1) | (2) | (3) |
| Clay | 2.0 | 0 | 0 |
| Polymer (Acrysol A-3 ®) | 0 | 2.0 | 0 |
| Metal Cation | 0 | 0 | 0.2 |
| Yield Point (pascals) | 2.2 | 3.5 | 0.0 |

The sum of the individual yield points is thus 5.7 pascals. Enhancement factors for several typical examples are calculated below.

| | Combined Yield Point (Pascals) | Sum of Individual Yield Points (Pascals) | Enhanement Factor |
|---|---|---|---|
| 2% clay, 2% polymer, 0.2% cation ($Al^{+3}$) | 29.0 | 5.7 | $\frac{29.0}{5.7} = 5.1$ |
| 2% clay, 2% polymer, 0.8% cation ($Al^{+3}$) | 39.6 | 5.7 | $\frac{39.6}{5.7} = 6.9$ |
| 2% clay, 2% polymer, 0.2% cation ($Zn^{+2}$) | 23.2 | 5.7 | $\frac{23.2}{5.7} = 4.1$ |

Table 6 demonstrate the effect of changing metal salt concentration. Increasing salt content with its concomitant increasing cation content increases the yield point and viscosity for the composition shown. This composition is similar to formulation 3 from Example I with the exception of the salt content and water content being varied to achieve 100%. These samples were tested one week after they were mixed. The enhancement factors are calculated in the same way as for Table 5.

TABLE 6

Effect of Cation Concentration on Yield Point and Viscosity (25° C.)

| Aluminum Sulfate.$18H_2O$ (wt %) | Yield Point (Pa) | Viscosity (Pa s) $5\ s^{-1}$ | Viscosity (Pa s) $21\ s^{-1}$ | Enhancement Factor |
|---|---|---|---|---|
| 0.00 | 16.4 | 8.3 | 2.7 | 2.9 |
| 0.05 | 20.6 | 8.9 | 3.1 | 3.6 |
| 0.10 | 19.3 | 9.1 | 3.2 | 3.4 |
| 0.20 | 29.0 | 9.2 | 2.8 | 5.1 |
| 0.40 | 32.8 | 12.4 | 3.7 | 5.8 |
| 0.60 | 33.8 | 13.4 | 5.1 | 5.9 |
| 0.80 | 39.6 | 13.5 | 4.6 | 6.9 |
| 1.00 | 54.7 | 19.0 | 6.6 | 9.6 |

The presence of multivalent metal cations in the autodish detergents of the invention improves hypochlorite stability relative to clay-polymer alone. The rate of hypochlorite degradation as a function of time is decreased when the metal ions are present. Hypochlorite stability of the samples is measured by monitoring the concentration of hypochlorite by titration. This is reported as % available chlorine. Table 7 shows the available chlorine content of samples stored at various temperatures. Formulations shown in this table contain clay-structuring (1), clay-polymer structuring (2), and clay-polymeraluminum (III) structuring (3) and are identical to the formulations in Example I. Clay-structured autodishwashing liquids are generally considered to be hypochlorite stable. It can be observed that multivalent metal cation containing formulation (3) approaches the clay-structured formulation (1) in hypochlorite stability.

TABLE 7

Hypochlorite Stability at Various Temperatures % Available Chlorine

| Formulation | Initial | Week 1 | Week 2 | Week 3 | Week 4 |
|---|---|---|---|---|---|
| at 40° C. | | | | | |
| (1) | 1.00 | 0.91 | 0.87 | 0.84 | 0.81 |
| (2) | 1.00 | 0.76 | 0.62 | 0.60 | 0.51 |
| (3) | 1.00 | 0.91 | 0.83 | 0.79 | 0.73 |
| at 50° C. | | | | | |
| (1) | 1.00 | 0.80 | 0.68 | 0.58 | 0.51 |
| (2) | 1.00 | 0.66 | 0.33 | 0.22 | 0.13 |
| (3) | 1.00 | 0.74 | 0.59 | 0.49 | 0.40 |

EXAMPLE III

The following formulation is prepared in a manner similar to that of Example II.

| | Weight % |
|---|---|
| Calcium Bentonite Clay | 2 |
| Sodium Tripolyphosphate | 20 |
| Sodium Carbonate | 6 |
| Polyacrylic Acid (avg. M.W. 190,000) | 1.5 |
| Sodium Hydroxide | 1.23 |
| Sodium Silicate (2.4:1 ratio) | 8.1 |
| Sodium Hypochlorite (available chlorine) | 1.0 |
| Aluminum Sulfate.$18H_2O$ | 0.2 |
| Ti $O_2$ | 0.2 |
| Defoamer (stearyl acid phosphate) | 0.16 |
| Water | Balance |
| | 100% |

Example IV

The preferred process including mix order, raw material selection, and temperature parameters suitable for a typical 8 Kg batch is described. Formulation 4 from Example II is used. Table 8 contains a listing of the components in the preferred order of addition. The temperatures at the point of addition of each component and the mixing time used is given. Times of mixing are typical for an 8 Kg batch and are critical only in the sense that the process requires certain chemical/physical changes be completed.

TABLE 8

| Component | Temp. C. | Mixing Time (min.) | Comments |
|---|---|---|---|
| Distilled water | 17 | 0 | Initial |
| Gelwhite GP Clay | 17 | 15 | dispersion of clay by vigorous agitation |
| | 45 | 30 | Apply Heat to swell clay |
| Sodium Tripolyphosphate (Hysorb from FMC Corporation) | 53 | 45 | STP Exotherm and apply heat |
| Polyacrylate Premix (described below) | 53 | 10 | added hot |
| Aluminum Sulfate 18 Hydrate | 58 | 10 | |
| Sodium Silicate (2.4 Ratio, 47% solution) | 53 | 4 | |
| Sodium Carbonate | 49 | 14 | Exotherm |

TABLE 8-continued

| Component | Temp. C. | Mixing Time (min.) | Comments |
|---|---|---|---|
| Defoamer Premix | 53 | 5 | |
| Dowfax 2A-1 (from Dow Chemical 45% solution) | 53 | 3 | |
| Sodium Tripolyphosphate | 56 | 60 | |
| (Hysorb from FMC Corporation) | 30 | 20 | Apply Cooling |
| Sodium Hypochlorite (12.0% Av. Chlorine) | 25 | 10 | |

A batch of autodish liquid including the above listed components was prepared using a Versamix (from Charles Ross and Sons, Inc.) of approximately 2 gallon capacity fitted with an anchor blade and a disperser blade.

Initially, two premixes were prepared.

A polymer premix was prepared by adding 192 g of sodium hydroxide 50% liquor to 640 g of Acrysol A-3 25% solution with agitation. The temperature of this premix was kept below 70° C. to minimize discoloration. This mixture was intentionally overneutralized to have a pH of about 12.9. The premix thus prepared, can be added to the slurry batch while either hot or cold.

A 2.6wt. % defoamer premix was prepared by homogenizing stearyl acid phosphate in water at 25° C. The stearyl acid phosphate used was "High mono grade" obtained from Occidental Chemical Company and was a mixture of monostearyl and distearyl acid phosphates. Alternatively, the defoamer premix may be prepared at 70° C. using conventional high speed agitation.

To a 4 L stainless steel beaker was added 2266 4g of distilled water at 17° C. The water was vigorously agitated using a mechanical stirrer. 160g of Gelwhite GP was then sifted into the water. The clay slurry thus formed was agitated vigorously for approximately 15 minutes and then transferred to the Versamix. The anchor blade was rotated at 13 rpm and the disperser blade at 500 to 800 rpm. Steam was applied to the Versamix jacket to raise the slurry temperature to 45° C. After approximately 30 minutes at this temperature the slurry appeared to be slightly thickened and 800 g of granular anhydrous sodium tripolyphosphate was added gradually and uniformly to avoid the formation of lumps. An exotherm of approximately 6° C. was noted after addition of the STP. The slurry temperature was adjusted to about 55 to 60° C. and stirring was continued for 45 to 60 minutes to free the slurry from granular non-hydrated STP.

The freshly prepared polymer premix was then added to the slurry while still hot and mixed for 10 minutes.

160g of aluminum sulfate .18$H_2O$ was then added to the slurry as a crystalline powder while avoiding lump formation and mixed for about 10 minutes.

The silicate, carbonate, defoamer premix and surfactant were then added stepwise with mixing to the slurry. 1422.4g of a 47 wt. % solids solution of 2.4 ratio (2.4:1 $SiO_2$:$Na_2O$) sodium silicate (from PPG) was added. 480g of sodium carbonate, grade 100 medium density ash (from Monsanto Company) was added. 616g of the defoamer premix was added. 640g of Dowfax 2A-1 surfactant was added as a 45 wt. % solution (received from Dow) approximately 10 minutes between additions was allowed to insure sufficient mixing.

The temperature of the mixture was maintained between 50–55° C. Addition of the second 800 g portion of sodium tri polyphosphate affords an exotherm of about 4° C. The speed of the disperser blade is decreased to approximately 200 rpm once addition of the second portion of STP is complete to avoid overshearing the liquid. The mixture was stirred until the STP granules were substantially hydrated (approximately 45–60 minutes). The mixture was then cooled with agitation to 30° C. These conditions produce a viscosity increase after about 20 minutes.

Then 666.4 g of a 12.0% available chlorine, hypochlorite solution was added and mixed for about 10 minutes to achieve uniformity of the batch. The batch thus prepared was found to have suitable rheological properties similar to those of formulation 4 in Example 2.

It is understood that the examples and embodiments described herein are for illustrative purposes only and that various modifications or changes in the light thereof will be suggested to persons skilled in the art and are to be included within the spirit and purview of this application and the scope of the appended claims.

What is claimed is:

1. An aqueous based fluid automatic dishwashing composition comprising:
   (a) a thickening system comprising a synthetic water-soluble polymer, a swellable clay, and a soluble ro solubilized multivalent cation,
   (b) a sufficient level of a source of available chlorine to produce at least about 0.5% thereof;
   (c) a sufficient amount of an alkaline source to produce a pH of at least about 10.5; and
   (d) a builder;

said composition being characterized by exhibiting thixotropic behavior, by having a yield point of about 30 to 100 pascals at 20° C., and by having an available chlorine level of at least about 0.5% by weight after about six weeks storage at 25° C.

2. A composition as defined in claim 1 wherein said water soluble polymer is a water soluble carboxylic polymer selected from the group consisting of polyacrylic acid and its salts, polymethacrylic acid and its salts, polymaleic acid and its salts and copolymers of acrylic acids or methacrylic acids with co-monomers selected from the group consisting of alkyl acrylates, alkyl methacrylates, maleic anhydrides, and mixtures thereof.

3. A composition as defined in claim 1 wherein said clay is selected from the group consisting of montmorillonites, hectorites, nontronites, beidillites, saponites, sauconites and mixtures thereof.

4. A composition as defined in claim 1 wherein said multivalent cation is selected from the group consisting of $Al^{+3}$, $Zn^{+2}$, $Sn^{+4}$ and mixtures thereof.

5. A composition as defined in claim 1 wherein said source of available chlorine is alkali metal or alkaline earth metal hypochlorites.

6. A composition as defined in claim 1 wherein said alkaline source is selected from the group consisting of alkali or alkaline earth metal hydroxides, alkali metal silicate and mixtures thereof.

7. A composition as defined in claim 1 wherein said builder is selected from the group consisting of alkali metal phosphate, alkali metal carbonate, zeolite and mixtures thereof.

8. An aqueous based fluid automatic dishwashing composition consisting essentially of:

| | Weight % of composition |
|---|---|
| Calcium Bentonite Clay | 2 |
| Sodium Tripolyphosphate | 20 |
| Sodium Carbonate | 6 |
| Polyacrylic Acid (avg. M.W. 190,000) | 1.5 |
| Sodium Hydroxide | 1.23 |
| Sodium Silicate (2.4:1 ratio) | 8.1 |
| Sodium Hypochlorite (available chlorine) | 1.0 |
| Aluminum Sulfate.$18H_2O$ | 0.2 |
| Ti $O_2$ | 0.2 |
| Defoamer (stearyl acid phosphate) | 0.16 |
| Water | Balance |
| | 100% |

9. An aqueous based fluid automatic dishwashing composition comprising:

| Component | Wt. % of Composition |
|---|---|
| Swellable Clay | 1–4% |
| Water-Soluble Carboxylic Polymer | 1–3% |
| Soluble or Solubilized Multivalent Metal Ion | 0.01–1.0% |
| Sodium Tripolyphosphate | 15–30% |
| Sodium carbonate | 5–15% |
| Sodium Silicate (1.0–3.25:1 weight ratio of $SiO_2$:$Na_2O$) | 5–15% |
| Sodium Hypochlorite | 0.1–2.0% |
| Sodium Hydroxide | 1–2.5% |
| Surfactant | 0–3.0% |
| Defoamer | 0–0.5% |
| Adjuvants | 0–5% |
| Water | Balance |
| | 100% |

said composition being characterized by exhibiting thixotropic behavior, a yield point of about 30 to 100 pascals at 25° C., and having an available chlorine level of at least about 0.5% by weight after about six weeks storage at 25° C.

10. A method for cleaning dishes comprising contacting said dishes with a 0.1% to 1.0% aqueous solution of the composition of claim 1 in an automatic dishwasher.

11. An article of manufacture comprising the composition of claim 1 disposed in a container with a reclosable dispensing orifice of 6mm to 12mm in axial length.

12. A process for preparing an aqueous based fluid automatic dishwashing composition, comprising:

(a) preparing an aqueous based dispersed thickening matrix by combining a synthetic water soluble polymer, swellable clay and a soluble or solubilized multivalent cation in water and in the absence of excess electrolyte;

(b) adding a builder to said matrix to form a final slurry;

(c) cooling said slurry; and (d) combining an available chlorine source with said slurry.

13. A process for preparing a fluid aqueous based automatic dishwashing composition comprising:

(a) dispersing a swellable clay in water at a temperature of about 15° to 25° C. to form a clay slurry;

(b) heating said clay slurry to about 40–50° C. to swell said clay;

(c) adding a portion of alkali metal tripolyphosphate to said slurry and agitating the mixture to hydrate said tripolyphosphate;

(d) adding a preformed overneutralized polymer premix to said slurry;

(e) dissolving a source of multivalent cations in said slurry;

(f) adding an alkali metal carbonate and an alkali metal silicate to said slurry;

(g) adding a defoamer premix and a surfactant to said slurry;

(h) adding a second portion of said alkali metal tripolyphosphate and agitating to hydrate said tripolyphosphate;

(i) cooling the slurry to a temperature of about 30° C. at a rate sufficiently rapid to provide for formation of fine crystalline hydrates; and (j) combining a source of available chlorine with said slurry.

* * * * *